US007073705B2

(12) United States Patent
Auclair et al.

(10) Patent No.: US 7,073,705 B2
(45) Date of Patent: Jul. 11, 2006

(54) CARTON WITH A GLUED INSERT AND A BLANK COMBINATION FOR FORMING THE SAME

(75) Inventors: Jean-Michel Auclair, Chateauroux (FR); Jean-Yves Daniel, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/364,539

(22) Filed: Feb. 10, 2003

(65) Prior Publication Data

US 2003/0146269 A1 Aug. 7, 2003

Related U.S. Application Data

(63) Continuation of application No. PCT/US01/24698, filed on Aug. 7, 2001.

(51) Int. Cl.
*B65D 25/04* (2006.01)

(52) U.S. Cl. ..... 229/120.24; 229/120.27; 229/120.29; 206/427

(58) Field of Classification Search ..... 229/120.24, 229/120.27, 120.29, 103.2, 120.04; 206/108, 206/499, 427

See application file for complete search history.

(56) References Cited

U.S. PATENT DOCUMENTS

| | | | | | |
|---|---|---|---|---|---|
| 2,124,808 | A | * | 7/1938 | White et al. | 229/120.04 |
| 3,070,276 | A | * | 12/1962 | Richardson | 229/120.27 |
| 3,115,073 | A | | 12/1963 | Kreimendahl | |
| 3,118,535 | A | * | 1/1964 | Bauman | 206/499 |
| 3,201,022 | A | * | 8/1965 | Glassco et al. | 229/120.24 |
| 3,696,990 | A | * | 10/1972 | Dewhurst | 206/427 |
| 3,868,055 | A | * | 2/1975 | Langen et al. | 229/120.27 |
| 3,951,332 | A | | 4/1976 | Torbeck | |
| 3,980,223 | A | | 9/1976 | Curran | |
| 4,294,398 | A | | 10/1981 | Chidsey, Jr. | |
| 4,469,222 | A | * | 9/1984 | Graser | 206/180 |
| 4,508,258 | A | * | 4/1985 | Graser | 229/103.2 |
| 4,679,726 | A | * | 7/1987 | Oliff | 229/138 |
| 5,108,030 | A | * | 4/1992 | Schuster et al. | 229/132 |
| 5,427,242 | A | * | 6/1995 | Oliff et al. | 206/430 |
| 5,518,111 | A | * | 5/1996 | Stout | 206/160 |
| 5,529,240 | A | | 6/1996 | Harris | |
| 5,826,783 | A | * | 10/1998 | Stout | 229/120.32 |

FOREIGN PATENT DOCUMENTS

| | | |
|---|---|---|
| GB | 858214 | 1/1961 |
| GB | 896479 | 5/1962 |

* cited by examiner

*Primary Examiner*—Tri M. Mai
(74) *Attorney, Agent, or Firm*—Tsugihiko Suzuki

(57) ABSTRACT

A package and two part blank for forming a package for carrying one or more articles comprising a carton having a plurality of wall panels for forming a tubular structure wherein each end of the carton is closed by a first panel hingedly connected to one of the wall panels, an intermediate panel hingedly connected to another wall panel of the carton and adapted to be placed in face contacting relationship within the inner face of the first panel. There further comprises within the carton an insert structure for supporting the one or more articles including a second panel. An aperture or recess is provided in the intermediate panel such that glue applied to an outer face of the second panel and the intermediate panel secures together said first, second and intermediate panels when placed together in face contacting relationship to close the end of the carton.

10 Claims, 14 Drawing Sheets

CARTON WITH A GLUED INSERT AND A BLANK COMBINATION FOR FORMING THE SAME

This is a continuation of international application No. PCT/US01/24698, filed Aug. 7, 2001, which is hereby incorporated by reference.

BACKGROUND OF THE INVENTION

The invention relates to a carton and blank for forming a carton for carrying a plurality of articles and an insert structure associated with the carton to provide additional protection to articles contained in the carton.

The use of an insert or partition in a carton is well known as a means to serve as a cushion between the articles and/or between the articles and the outer walls to protect them. In such known cartons, the insert is free to move in a vertical plane, which is undesirable because the insert will no longer serve as a cushion if moved in an upward position, for example between bottle necks.

Some inserts are formed from a unitary blank, which can reduce the rigidity of the erected insert. Examples of inserts formed from a single blank are shown in U.S. Pat. No. 4,294,398 and U.S. Pat. No. 5,529,240.

SUMMARY OF THE INVENTION

The present invention seeks to overcome or at least mitigate the problems of the prior art.

One aspect of this invention provides a package for carrying one or more articles comprising a carton having a plurality of wall panels for forming a tubular structure wherein each end of the carton is closed by a first panel hingedly connected to one of the wall panels, an intermediate panel hingedly connected to another wall panel of the carton and adapted to be placed in face contacting relationship within the inner face of the first panel. There further comprises within the carton an insert structure for separating and supporting the one or more articles including a second panel. An aperture is provided in the intermediate panel such that glue applied to an outer face of the second panel and the intermediate panel secures together said first, second and intermediate panels when placed together in face contacting relationship to close the end of the carton.

One advantage of this arrangement is that the insert structure is held in position adjacent the carton bottom. Holding the insert structure in this position is important to allow the insert structure to function as a cushion between the bottles. Beneficially, the amount of board used for the insert structure can be reduced and standard equipment to secure the end panels can be used to secure the insert structure to the outer carton.

Preferably, the intermediate panel may be provided by an end flap and the aperture is provided by a recess struck from the free side edge of the end flap. More preferably, a second end flap may be provided with a recess in registry with the first recess such that the first panel is secured directly to the second panel by the application of glue to that part of the second panel on display through the first and second recesses.

According to an optional feature of this aspect of the invention the insert structure may comprise a medial panel secured to one of the outer panels and a transverse partition panel foldably connected to a medial panel by a pair of spaced fold lines intermediate the opposing ends of the transverse partition panel thereby to create a panel which extends outwardly from both sides of said medial panel when the insert structure is formed in a set up carrier. Preferably, the second medial panel may be provided with a transverse partition panel hingedly connected thereto so as to be secured to the transverse partition panel of the first medial panel.

In one class of embodiments, one or more of the top and end panels are defined by a frangible connection to facilitate detachment of part of the package to a display window with access to the articles contained therein.

Optionally, there further comprises a handle struck from and hingedly secured to one or more of the end or top panels.

A second aspect of the invention provides a carton comprising a plurality of panels for forming an outer carton and an insert structure comprising a medial panel secured to one of the outer panels and a transverse partition panel foldably connected to a medial panel by a pair of spaced fold lines intermediate the opposing ends of the transverse partition panel thereby to create a panel which extends outwardly from both sides of said medial panel when the insert structure is formed in a set up carrier.

An advantage with the preferred feature is that the insert structure is more rigid because the opposed transverse partition panels are secured together.

Preferably, a second medial panel may be secured to one of the outer carton panels by a spacer panel separating the first and second medial panels. More preferably, the second medial panel may be provided with a transverse partition panel hingedly connected thereto so as to be secured to the transverse partition panel of the first medial panel.

A third aspect of the invention provides a blank for forming a carton for carrying a plurality of articles comprising a top, bottom and opposing side wall panels hingedly connected together in series, an end panel hingedly connected to the base panel and an end flap hingedly connected to a side wall panel and a separate blank for forming an insert including a securing panel connected to medial panel having a transverse partition panel struck there from. An aperture is provided in the end flap such that during construction of the carton glue is applied to an outer face of the securing panel and end flap to secure together said end panel, end flap and securing panel when placed together in face contacting relationship in a set up condition.

Preferably, the intermediate panel may be provided by an end flap and the aperture is provided by a recess struck from the free side edge of the end flap. More preferably, a second end flap is provided with a recess in registry with the first recess such that the first panel is secured directly to the second panel by the application of glue to that part of the second panel on display through the first and second recesses.

According to an optional feature of the third aspect of the invention the insert structure may comprise a medial panel secured to one of the outer panels and a transverse partition panel foldably connected to a medial panel by a pair of spaced fold lines intermediate the opposing ends of the transverse partition panel thereby to create a panel which extends outwardly from both sides of said medial panel when the insert structure is formed in a set up carrier.

A fourth aspect of the invention provides a blank for forming an insert structure comprising a medial panel having a transverse partition panel secured thereto, wherein the transverse partition panel foldably connected to a medial panel by a pair of spaced fold lines intermediate the opposing ends of the transverse partition panel thereby to create a panel which extends outwardly from both sides of said medial panel when the insert structure is formed in a set up carrier. Preferably, a second medial panel may be secured to one of the outer panels by a spacer panel separating the first and second medial panels.

BRIEF DESCRIPTION OF THE INVENTION

Exemplary embodiments of the invention will now be described, by way of example only, with reference to the accompanying drawings in which.

DETAILED DESCRIPTION OF THE PREFERRED EMBODIMENTS

Figure 1:
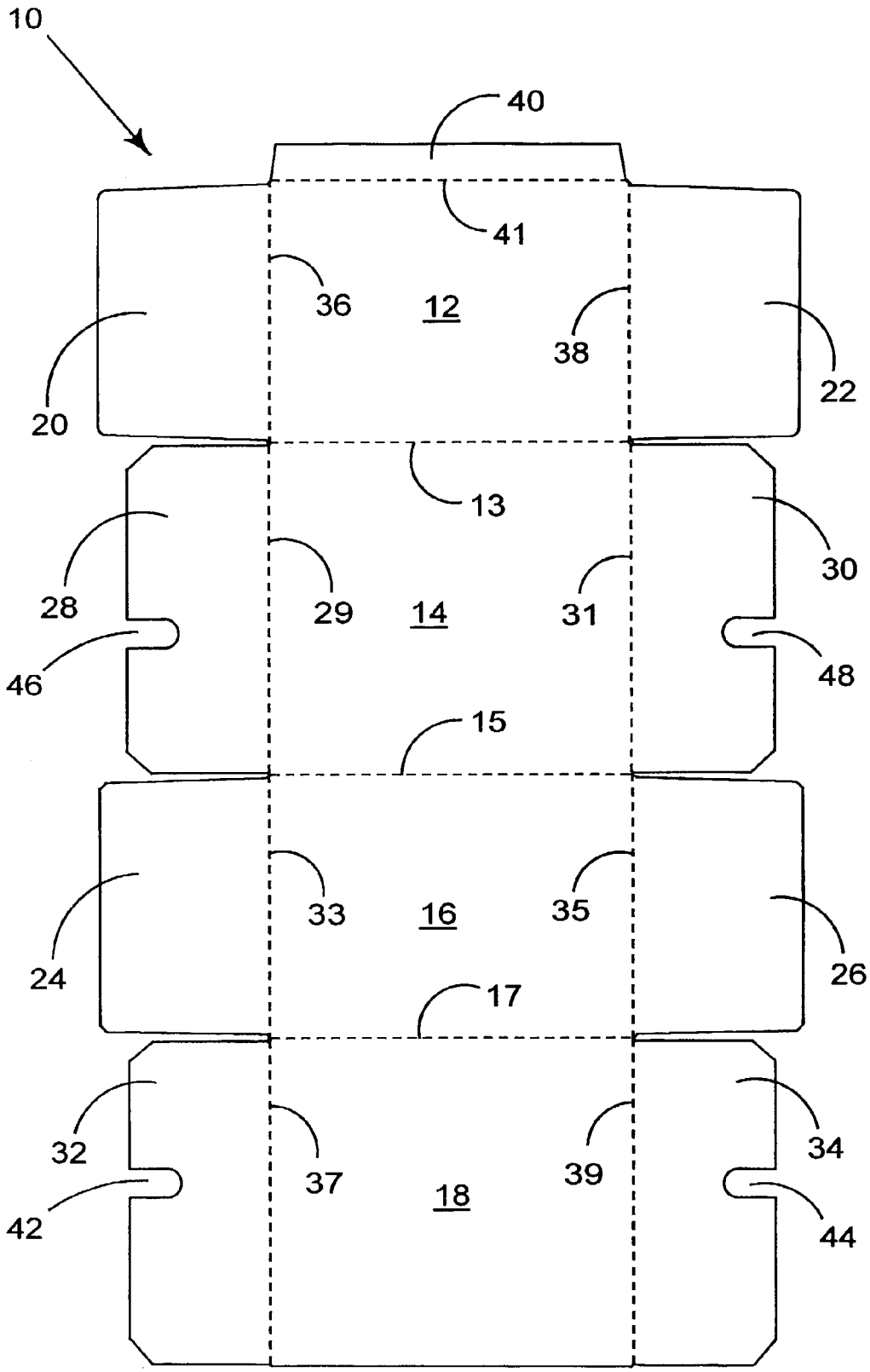
FIG. 1 illustrates the blank for forming the outer carton according to a first embodiment of the invention.
Figure 2:
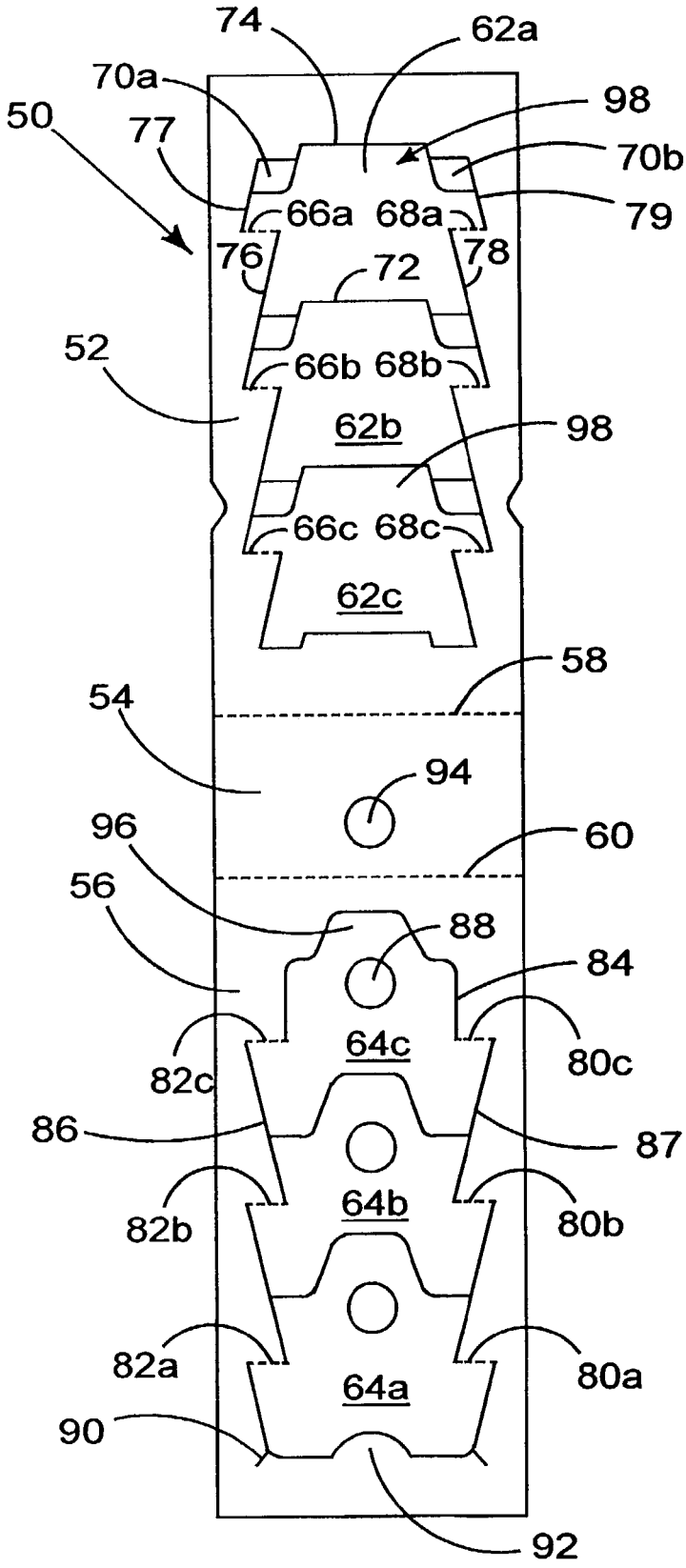
FIG. 2 illustrates the blank for forming the insert structure according to a first embodiment of the invention.

Referring to the drawings and in particular, FIGS. 1 and 2, there is shown one embodiment of a blank for forming a carton and a blank for forming an insert structure made from paperboard or similar foldable sheet material. It is envisaged that a unitary blank for the carton and insert structure could be used without departing from the scope of invention. In the embodiments described below, the carton is a "fully-enclosed" type although it will be recognized that the invention could be applied to a "wraparound" type carton or "basket-type" carton where it is required to secure an insert structure to one of the outer panels.

Turning to the first embodiment shown in FIG. 1, the blank 10 comprises a plurality of panels for forming the top, base and opposed side walls whereby there is shown a top panel 12, a first side wall panel 14, bottom panel 16 and second side wall panel 18 hingedly connected one to the next in series along fold lines 13, 15 and 17 respectively.

The ends of the carton are constructed by one or more end panels. In this embodiment, opposed end panels 20 and 22 are hingedly connected to the opposing ends of top wall panel 12 along fold lines 36 and 38 respectively. A second pair of end panels 24, 26 is provided along opposing end edges of base panel 16 and hingedly connected thereto along fold lines 36 and 38 respectively.

Preferably, a pair of end flaps 28, 30 is hingedly connected to first side wall panel 14 along opposing end edges and are connected thereto by fold lines 36, 38 respectively. Likewise, a second pair of end flaps 32, 34 are hingedly connected to side wall panel 18 along fold lines 36, 38 respectively. The end panels 20, 22; 32, 34 are usually secured to the end flaps, so that in use, the end flaps support the end walls to improve rigidity.

There may further comprise one or more recesses struck from end flaps. In use, the recess enables the insert structure I (FIG. 4) to be secured to one or more of the end panels 20, 24, described below. In this embodiment, a pair of recesses 42, 46 are provided in end flaps 28, 32 that are positioned in corresponding positions along the opposing side edges, so as to marry up when the carton is erected. Preferably, a second pair or recesses 44, 48 is applied to the opposing end flaps 30, 34 so that the insert structure can be inserted from either end to be secured to the outer carton described in more detail below.

It is envisaged that the recess is not limited to the shape illustrated in FIG. 1 and indeed could be replaced by other means to allow the insert structure to juxtapose the end panel. For example, end flap 28 could terminate at the lower edge of recess 46 or, alternatively one or more apertures could be struck from end flaps 28 and/or 32.

Turning to the construction of the insert structure, there comprises a blank 50, as shown in FIG. 2, comprising one or more medial partition panels and a securing panel. There further comprises at least one transverse partition panel. Therefore, for a carton holding a group of four articles in a 2×2 arrangement, a single medial panel and transverse partition panel is required together with the end panel. Other arrangements are envisaged, so that for three rows of articles, two medial partition panels are provided.

In the illustrated embodiment, there comprises a first medial partition panel 52, an end panel 54 and second medial partition panel 56 hingedly connected together along fold lines 58 and 60 and adapted to receive twelve articles in a 3×4 arrangement.

FIG. 2 shows medial partition panel 52 is provided with three transverse partition panels 62*a*, 62*b* and 62*c*. Each transverse partition panel is similar and therefore only partition panel 62*a* is described in any greater detail.

Transverse partition panel 62*a* is connected to medial partition panel 52 along upper and lower fold lines 66*a* and 68*a* to create a panel that extends outwardly from both sides of the medial panel 52. It will be seen from FIG. 2 that, in this embodiment, fold lines 66 and 68 are aligned in a vertical plane. The upper and lower edges of panel 62*a* are adapted to extend one side of the medial panel are defined by cut lines 76 and 78 respectively which separate the panel 62*a* from medial panel 52. Cut line 76 extends from the lower end of fold line 66 to the upper end of the upper fold line 66*b* connecting panel 62*b* to medial panel 52. Similarly, cut line 78 extends from the upper end of fold line 68 to the lower end of the lower fold line connecting panel 62*b* to medial panel 52.

Further cut lines 77 and 79 define respectively the upper and lower edges of the part of the transverse partition panel that will extend outwardly from the other side of the medial panel 52. The opposing side edges of transverse partition panel 62*a* are provided by cut lines 72 and 74 respectively and optionally, apertures 70*a*, 70*b*.

Adjacent one of the side edges 74 of partition panel 62*a*, there comprises a protruding portion 98 used to overlap the portion 96 of transverse panel 64*a* struck from the other medial partition panel 56 and described in more detail below.

The second medial partition panel is also provided with three transverse partition panels 64*a*, 64*b* and 64*c*. It will be seen that each transverse partition panel is similar and therefore only partition panel 64*c* is described in any greater detail.

Transverse partition panel 64*c* is similar to transverse partition panel 62*a* in that it is preferably adapted to extend outwardly on both sides of the medial panel 56. Thus, panel 64*a* is connected to medial partition panel 56 along fold lines 80*c* and 82*c* that are aligned in a vertical plane, in this embodiment. The upper and lower edges of panel 64*a* to extend one side of the medial panel are defined by cut lines 86 and 87 respectively which separate the panel 64*a* from medial panel 56. Cut line 86 extends from the upper end of fold line 82*c* to the lower end of the upper fold line 82*b* connecting panel 64*b* to medial panel 56. Similarly, cut line 87 extends from the lower end of fold line 80*c* to the upper end of lower fold line 80*b* connecting panel 64*b* to medial panel 56. A further cut line 84 is shaped to define the part that will extend outwardly from the other side of the medial panel 56. Cut line 84 also defines a protruding portion 96 used to overlap the portion 98 struck from the transverse panel 62*c* of other medial partition panel 52 and described in more detail above.

There may further comprise a tab 92 and cut lines 90 extending from the end edge of transverse panel 64*a*. Additionally or alternatively, there may also comprise apertures 70 struck from medial panel 52. In use, they assist in causing the panels 62*a*, 64*a* to separate from the medial panels 52 and 56 respectively.

A plurality of apertures 88, 94 struck from each of the transverse partition panels 64*a*, 64*b*, 64*c* and a corresponding aperture 94 may be struck from end panel 54 may be provided: they are used by suitable machinery to open the transverse panels 64 during the mechanical construction of the insert structure.

Turning now to the second embodiment of the present invention, as illustrated in FIGS. 6 to 13 which is similar to the first embodiment and therefore, like numerals have been where possible used to denote like parts with the addition of the prefix "1". Only the differences between the first and second embodiments will be described in any greater detail.

Figure 6:
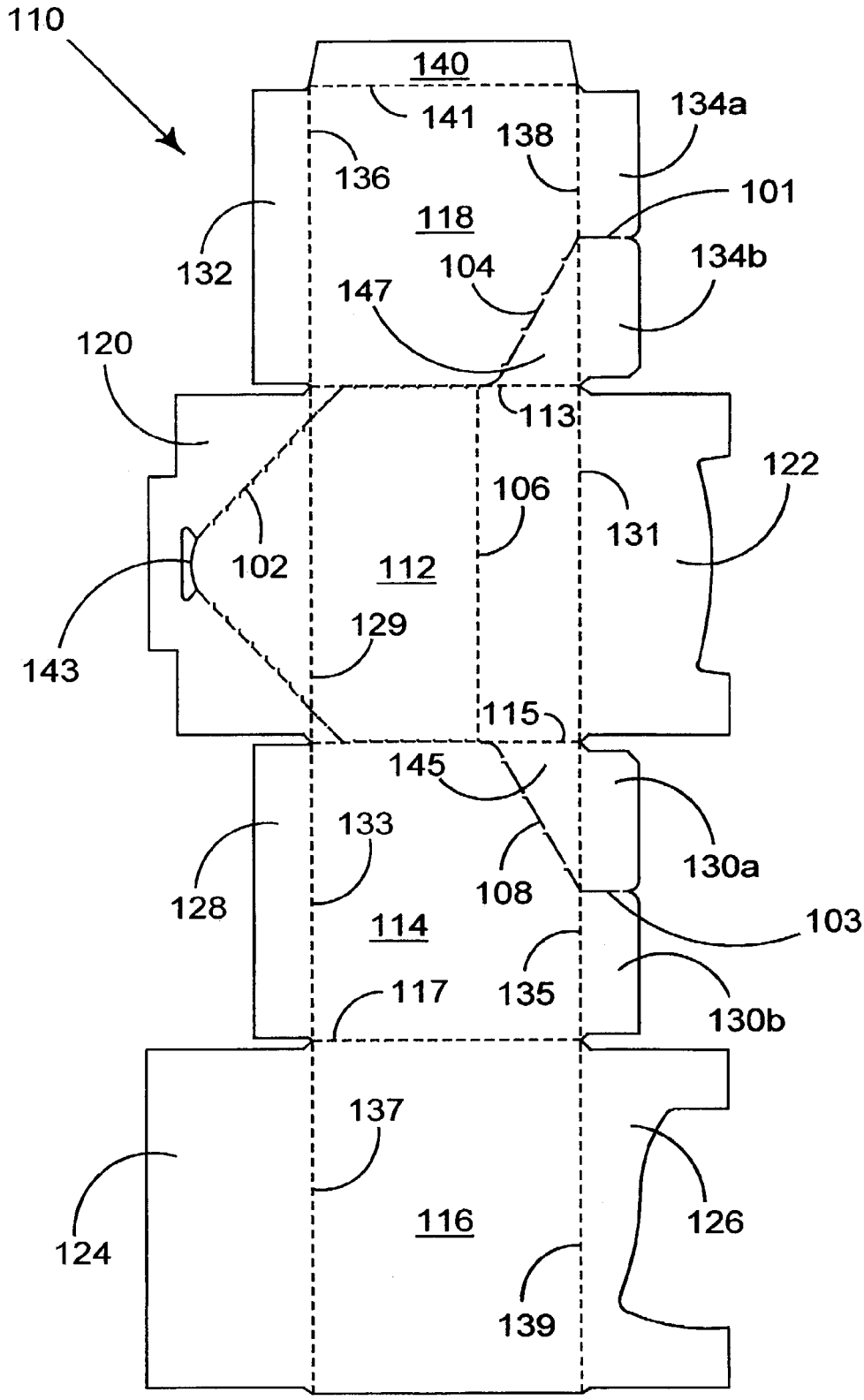
FIG. 6 illustrates the blank for forming the outer carton according to a second embodiment of the invention.

In this embodiment, the recesses 142, 146 are provided at opposed and spaced positions in end flap 120, as shown in FIG. 6. Furthermore, the means to connect the outer panel to the insert structure is provided on one end of the carton only.

The blank is adapted to receive one or more articles, for example sachets and to be displayed within the carton by means of a display window formed by recesses in end panels 122 and 126. In order to gain access to the interior of the carton an access structure is provided, which in this embodiment is provided by a plurality of frangible lines. The frangible lines 101, 104, 102, and 108 are formed in the panels 134, 118, 120, 114 and 130 to define a removable cover. The cover is provided by panels 147 and 145 as well as end flap 122 top panel 112 and part of end flap 120. To assist in removing the cover an aperture and finger tab 143 are provided in end flap 120.

In some embodiments the cover is provided with a fold line 106, which is used to partially fold back the cover to reveal the contents of the carton.

Figure 7:
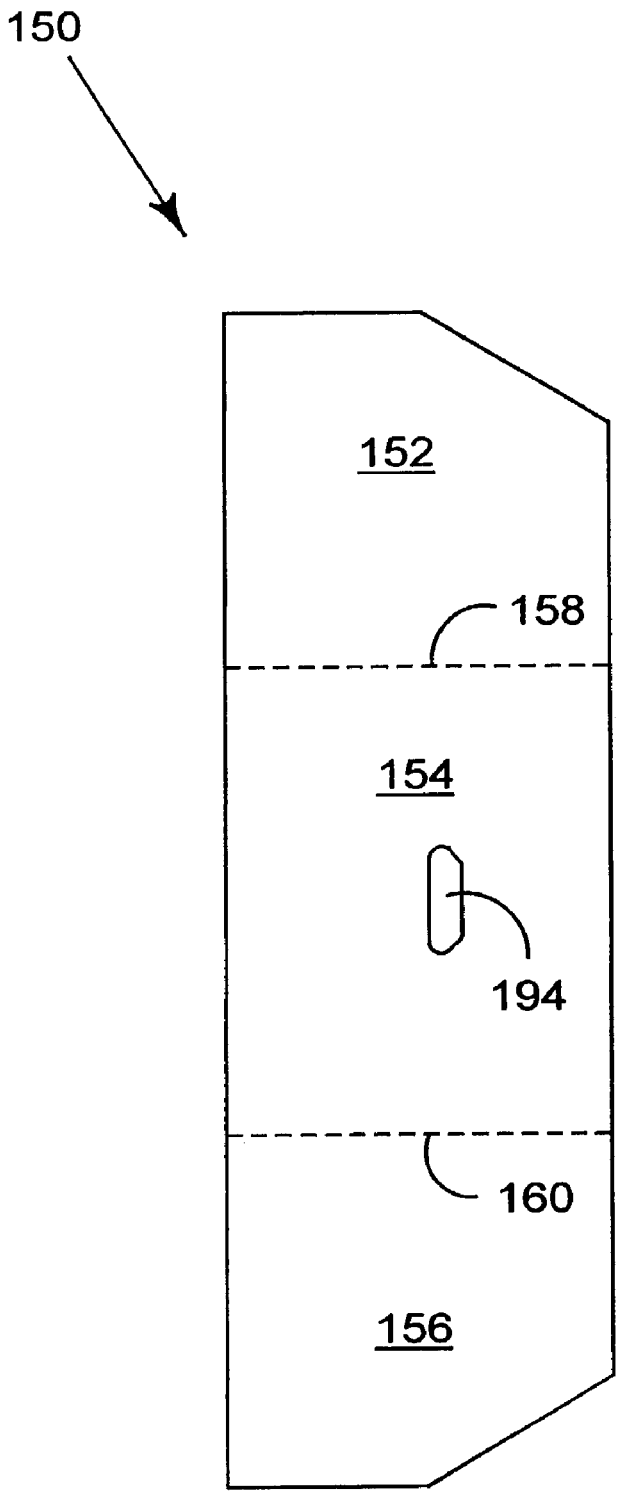
FIG. 7 illustrates the blank for forming the insert structure according to a second embodiment of the invention.

The insert structure 150 is illustrated in FIG. 7 and are placed intermediate the outer edges of the sachets and the outer walls to provide extra protection. In this embodiment, there are opposed medial panels 152 and 156 and securing panel 154 hingedly connected together along fold lines 158 and 160, as shown in FIG. 7.

Turning now to the third embodiment of the present invention, as illustrated in FIGS. 14 to 18 which is similar to the first embodiment and therefore, like numerals have been where possible used to denote like parts with the addition of the prefix "2". Only the differences between the first and third embodiments will be described in any greater detail.

Figure 14:
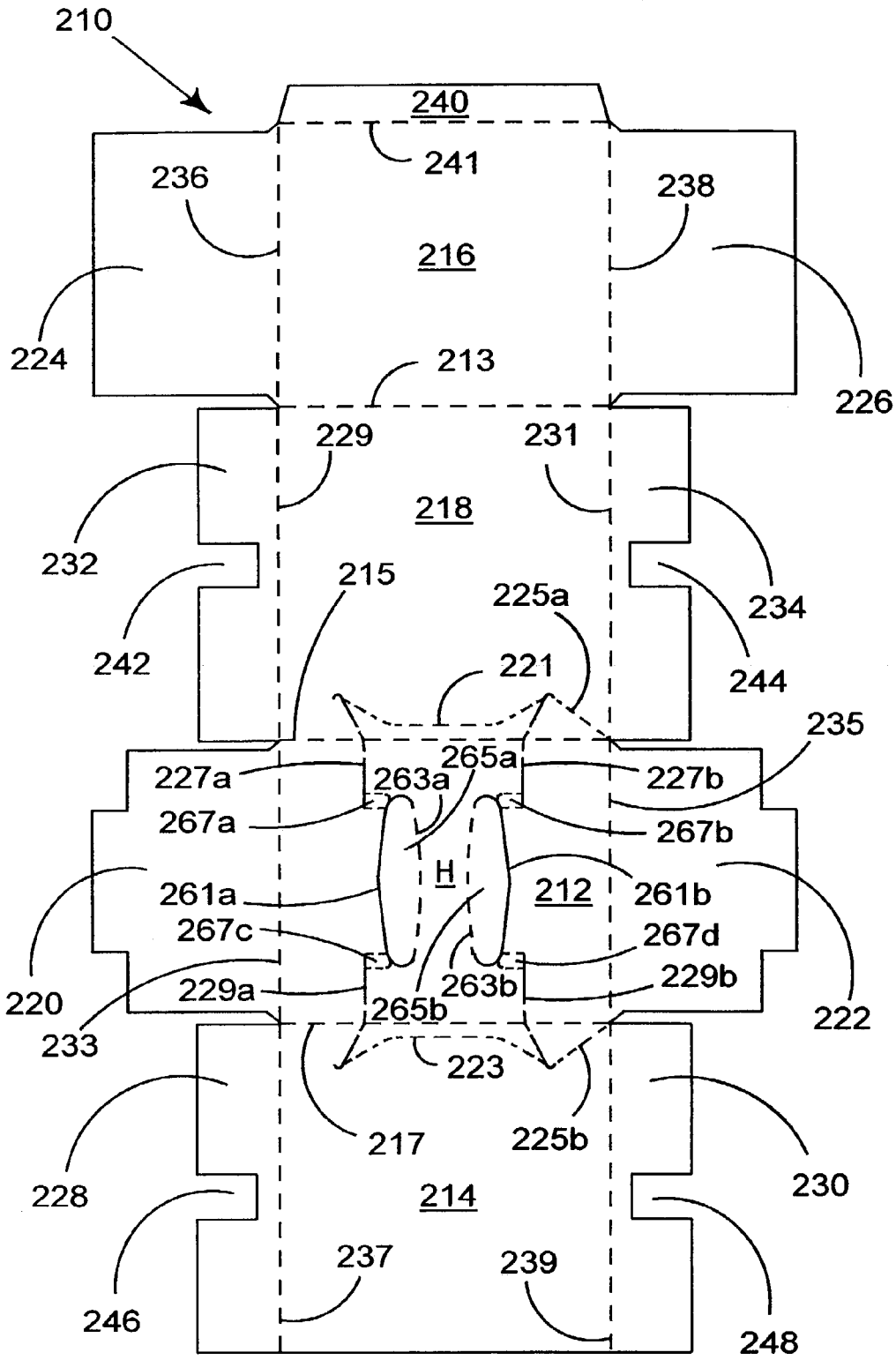
FIG. 14 illustrates the blank for forming the outer carton according to a third embodiment of the invention.

It will be seen from FIG. 14 that the construction of the end panels 224, 226; 220, 222 and end flaps 232, 234; 228, 230 is very similar to the first embodiment. The principal difference is that in this embodiment there is provided a handle structure. The handle is struck from top panel 212 by opposed cut lines 227*a*, 227*b*; 261*a*, 261*b*; 229*a*, 229*b* to define a handle strip H and is hingedly connected thereto along fold lines proximate a central portion of top panel 212.

Preferably, the handle strip H extends into the adjacent side or end walls. In this embodiment, the handle strip extends into side wall panels 218 and 214 and is hingedly connected thereto along fold lines 221 and 223 respectively. The handle strip is separated from side wall panels 218 and 214 by extensions of cut lines 227 and 229 respectively that terminate at the ends of fold lines 221 and 223. There may further comprise hand support flaps 265 hingedly connected to opposed side edges of handle strip H.

The insert blank 250 is illustrated in FIG. 15 and, again, is placed intermediate the outer edges of the sachets and the outer walls to provide extra protection. In this embodiment, there are opposed medial panels 252 and 256 and securing panel 254 hingedly connected together along fold lines 258 and 260, as shown in FIG. 15.

The insert blank 250 is also provided with additional flaps 251 and 257. In use, the flaps envelop the sachets to be held in position, as they are loaded into the carton.

Figure 15:
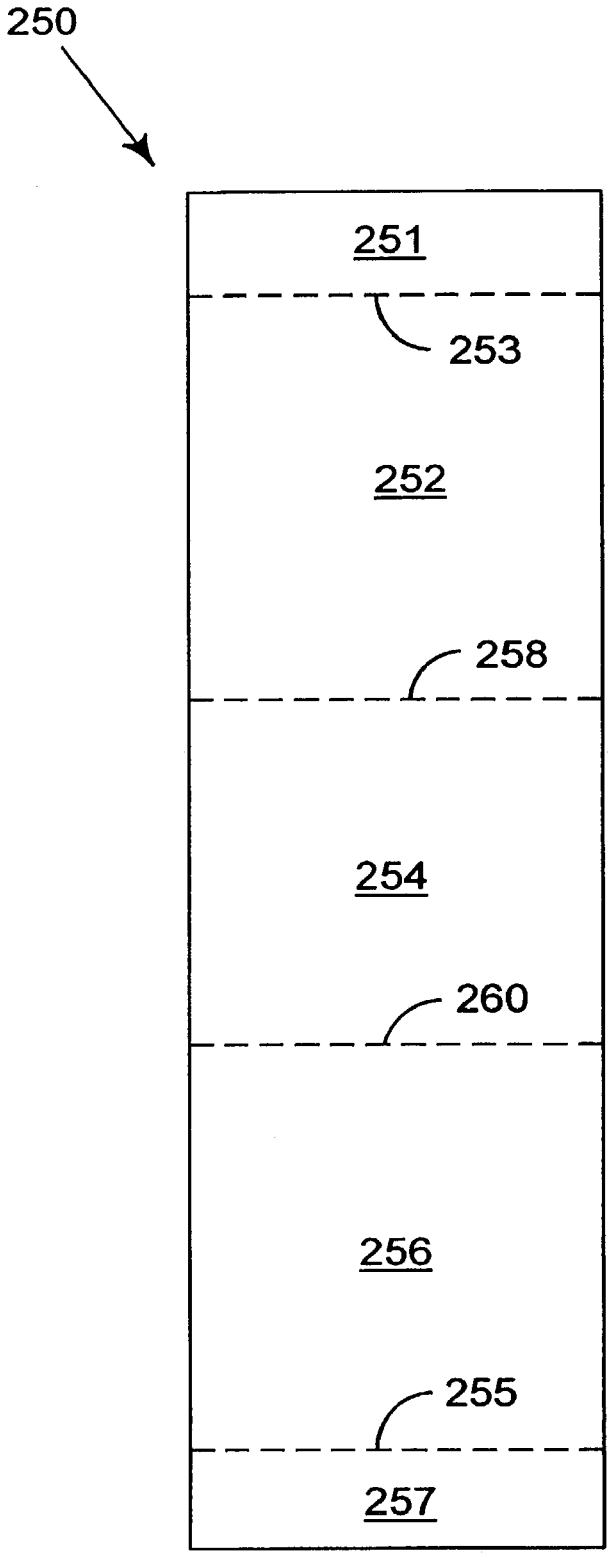
FIG. 15 illustrates the blank for forming the insert structure according to a third embodiment of the invention.

Turning to the construction of the carton from any of the carton blanks illustrated in FIG. 1, 6 or 14 and the insert structure from the insert blanks illustrated in FIG. 2, 7 or 15 each blank requires a series of sequential folding and gluing operations which are preferably performed in a straight line machine, so that the carton and blank are not required to be rotated or inverted to complete its construction. The folding process is not limited to that described below and can be altered according to particular manufacturing requirements.

Dealing with the construction of the insert structure I of the first embodiment from the blank 50, shown in FIG. 2, the medial partition panels 52 and 56 are folded out of alignment from securing panel 54 along fold lines 58, 60 to be placed in a substantially perpendicular arrangement, whereby the medial partition panels 52 and 56 are substantially parallel and in a spaced arrangement. To construct the individual cells O (shown in FIG. 3), the transverse partition panels 62 and 64 are moved out of alignment with medial partition panels 52 and 56 respectively. Turning first to transverse partition panel 62*c*, the panel is folded along fold lines 66*c* and 68*c* so that the protruding portion 98 is folded inwardly on one side of the medial panel 52. It will be seen that the transverse partition panel 62*c* is caused to pivot about fold lines 66*c* and 68*c* so that the panel extends from both sides of the medial panel 52. Preferably, the transverse partition panel 62*c* is substantially perpendicular to the medial panel 52. Likewise, transverse partition panels 62*a* and 62*b* are formed in a like manner.

Transverse partition panels 64*a*, 64*b*, 64*c* are formed in a like manner whereby panel 64*c* is folded out of alignment with medial panel 56 along fold lines 80*c* and 82*c* and is caused to pivot so that the transverse panel 64*c* extends from both sides of the medial panel 56 in a substantially perpendicular relationship with respect to it. Protruding portion 96 extends inwardly and comes into abutment with corresponding protruding portion 98. Preferably, the corresponding protruding parts 96, 98 are secured together by glue or other suitable means known in the art which creates a rigid insert structure I.

Figure 3:
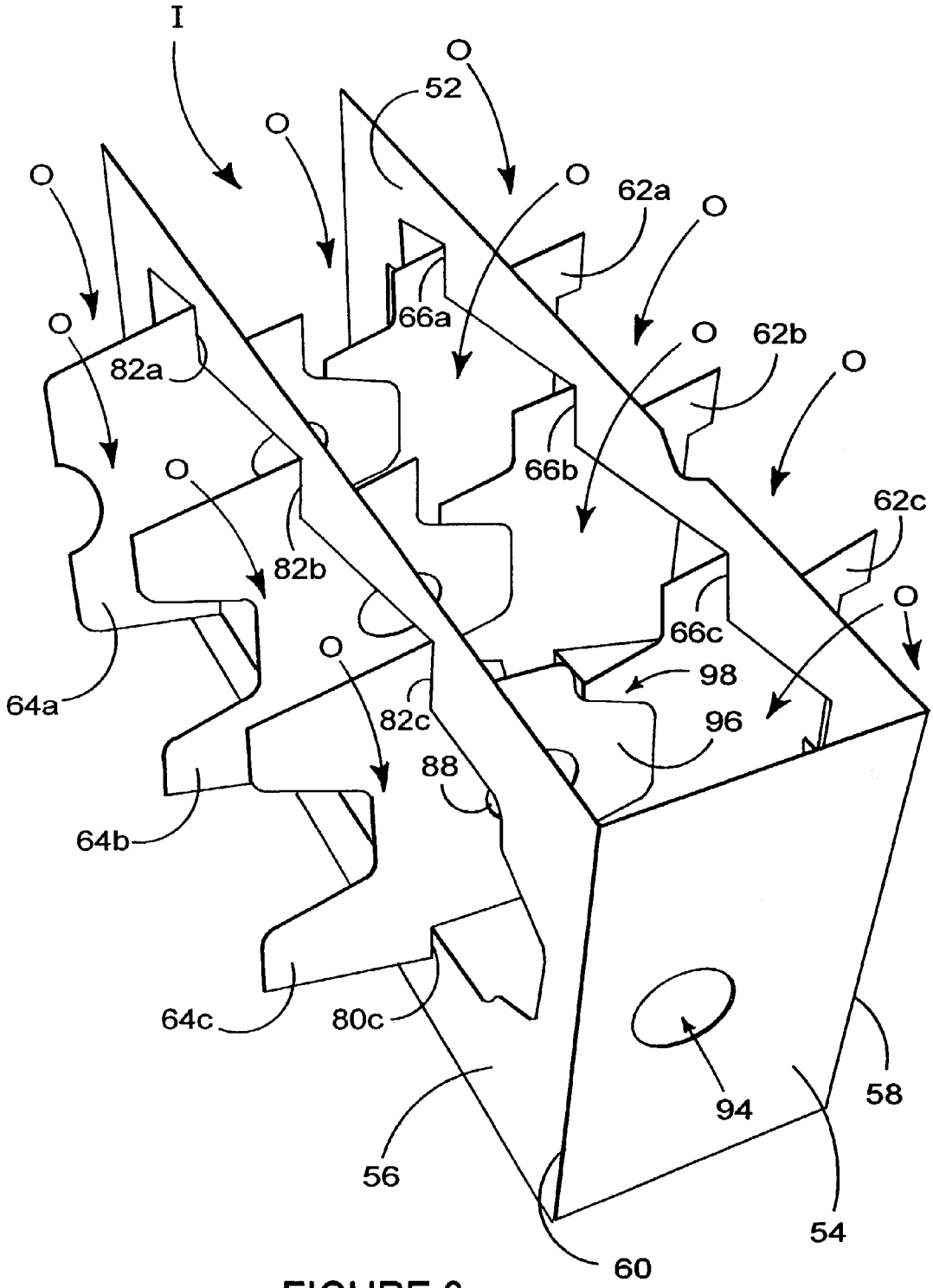
FIG. 3 illustrates the insert structure in a set up condition formed from the blank shown in FIG. 2.

Panels 64*b* and 64*a* are formed in a like manner and shall therefore not be described in any greater detail. Thus, the insert structure is in a set up condition as shown in FIG. 3. It will be seen that there are twelve cells O formed to separate and support the articles in adjacent cells.

The insert structure I is ready to receive the articles, which are loaded by relative vertical movement between the articles A and the insert structure I during forward feed movement. The articles enter their respective cells through the open bottom of the insert structure. Alternatively, the articles can enter their respective cells through the top of the insert structure I.

Figure 4:
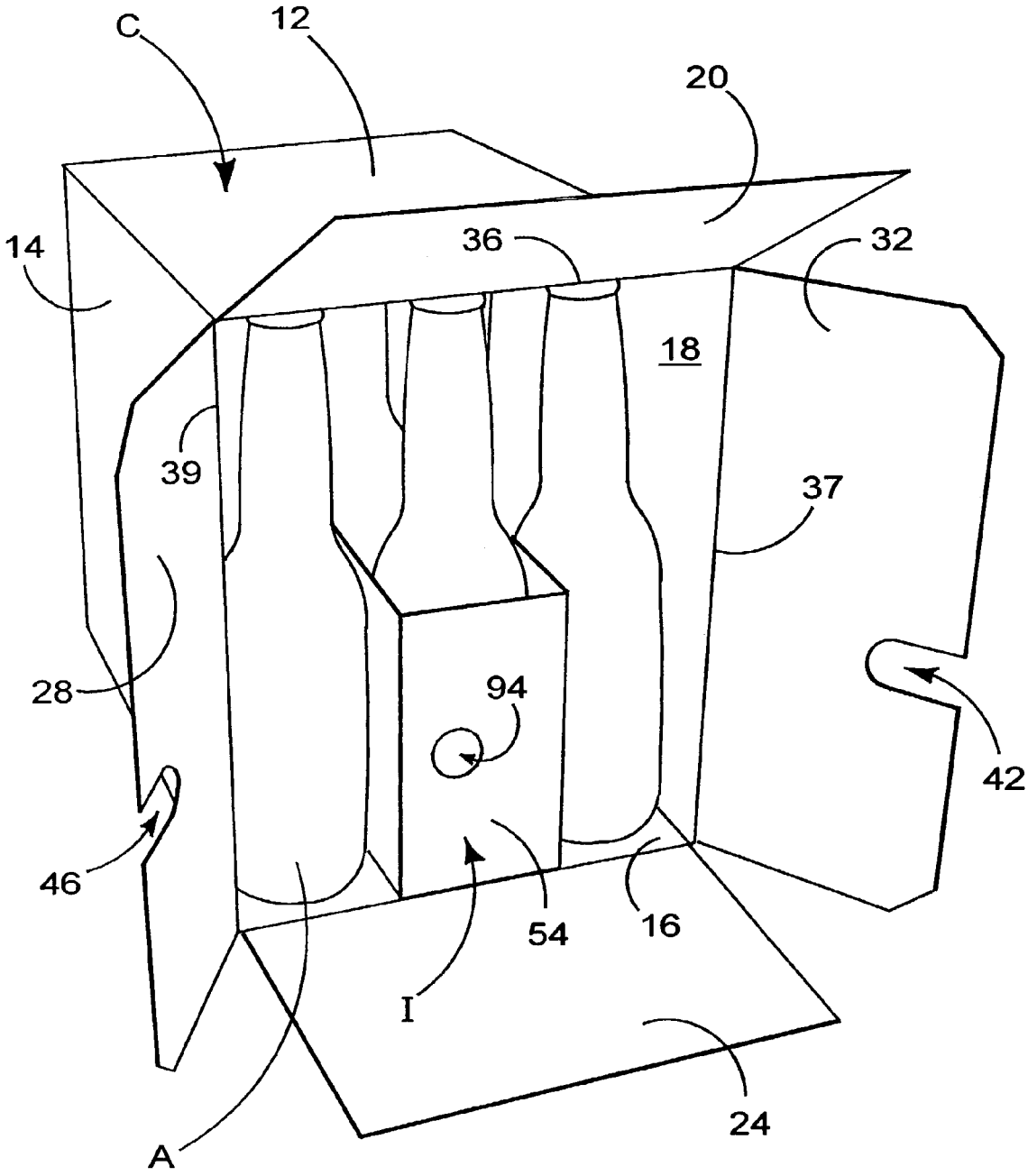
FIG. 4 shows the carton and insert structure in an erected and loaded condition with the articles.

The outer carton C is constructed by folding top panel 12, first side wall panel 14, base panel 16 and second side wall panel 18 out of alignment with each other along fold lines 13, 15 and 17 to be folded into a tubular structure, shown in FIG. 4. Top panel 12 and side panel 18 are secured together by securing flap 40. In those embodiments with securing flap 40, it is secured to side panel 18 by folding along fold line 41 to be secured to the side panel 18 by glue or other suitable means known in the art.

The carton is at an intermediate stage of construction whereby the articles and insert structure are inserted into the carton C from one of the ends. It will be seen from FIG. 4 that the end panels 20 and 24 and end flaps 28 and 32 are folded outwardly along fold line 36 to guide the articles and insert structure into the carton. Preferably, the opposing end wall is formed prior to receiving the articles whereby end flaps 30 and 34 are folded inwardly along fold lines 31 and 39 respectively. Thereafter, end wall panels 22 and 26 are folded inwardly along fold lines 35 and 38 to be secured to the end flaps 30 and 32 by glue or other suitable means known in the art. Thus, the carton is at the stage illustrated in FIG. 4.

Figure 5:
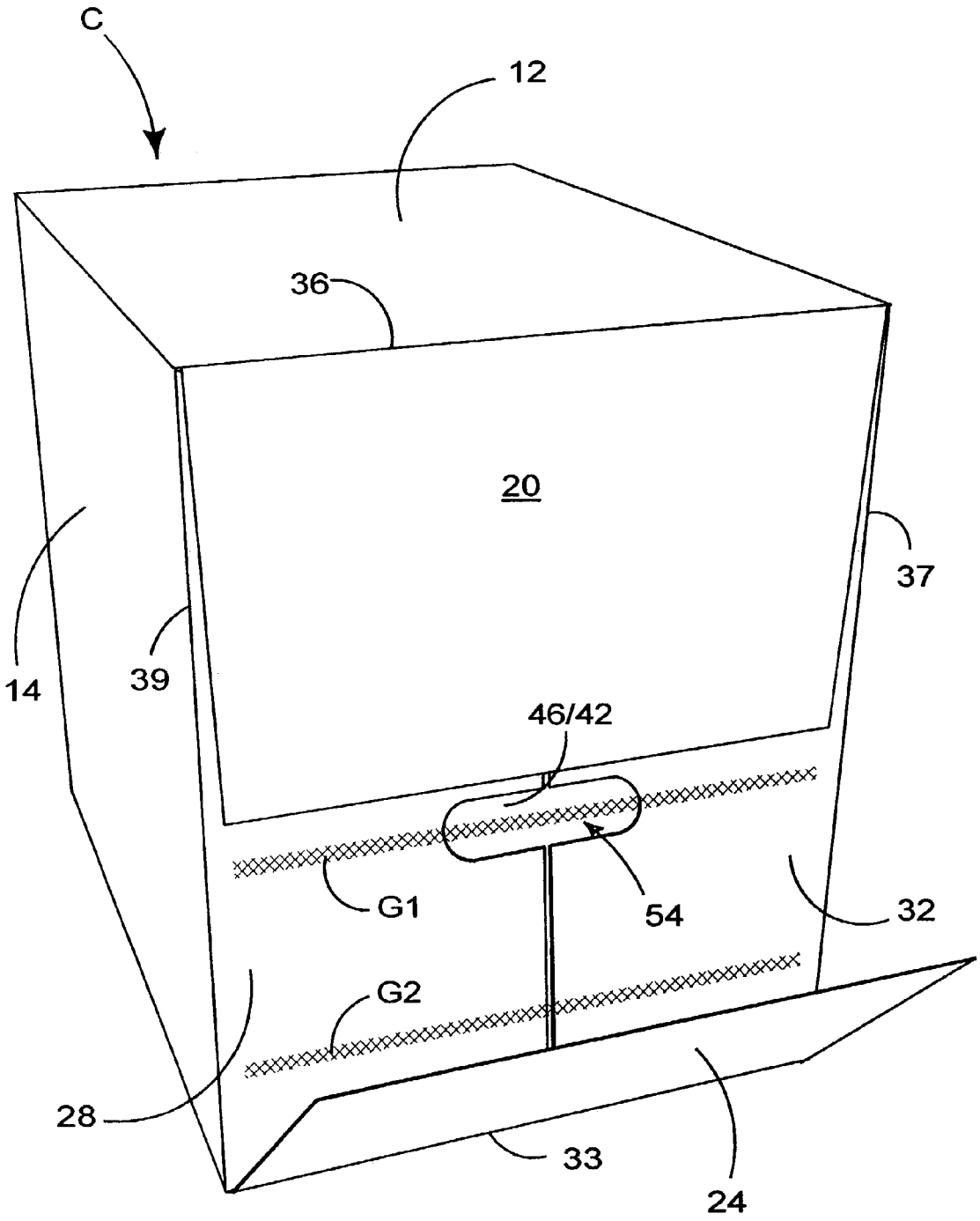
FIG. 5 illustrates the erected and loaded carton illustrated in FIG. 4, with the end panels secured to the end flaps to complete its construction.

In order to complete construction of the carton C, the insert structure I should be secured to one of the end wall panels 20 or 24. To this end, the end flaps 28 and 32 are folded inwardly along fold line 36 so that a portion of the end flaps 28, 32 come into abutment with the end wall 54 of insert structure I, and the recesses 42 and 46 are aligned, as shown in FIG. 5.

End wall panel 20 is folded downwardly along fold line 36 and is, optionally, secured to the end flaps 28 and 32 by glue or other suitable means known in the art. Alternatively, the end wall 20 is held in place by end wall panel 24, which is secured to the end flaps described below. Thereafter, the lower end wall panel 24 is folded inwardly along fold line 33 and secured to the end flaps 28 and 32 by glue, such as glue strip G2, or other suitable means known in the art. In order to secure the insert structure I to end wall panel 24, a strip of glue G1 is, in this embodiment, applied in a substantially straight line intermediate opposing side edges of the end flaps such that the glue is applied through recesses 42, 46 to the insert structure.

In alternative embodiments, glue may be applied to different areas of the blank such as where apertures are used instead of the recess. By folding the end wall panel 24 inwardly, it is secured in face contacting relationship with the end flaps 28 and 32 and, the part of the insert structure I revealed by the recesses 42, 46. In this way, the insert structure I is secured directly to an outer wall of the carton by the application of glue in a standard method i.e. using a straight line gluing gun. Thus, the carton is in a set up condition.

Figure 8:
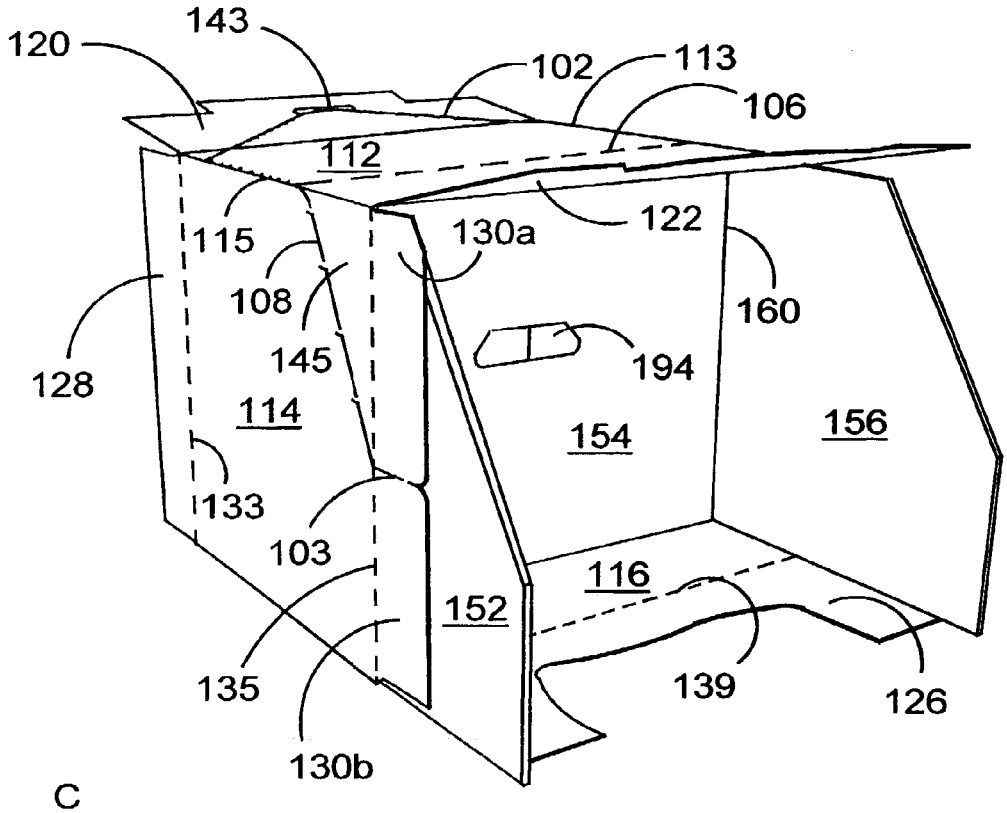
FIGS. 8, 9 and 10 illustrate the construction and loading of the carton from the blank of FIG. 6.

The construction of the carton of the second embodiment is similar to the first embodiment in that the outer carton C is constructed by folding top panel 112, first side wall panel 114, base panel 116 and second side wall panel 118 out of alignment with each other along fold lines 113, 115 and 117 to be folded into a tubular structure, shown in FIG. 8. Base panel 116 and side panel 18 are secured together. In those embodiments with securing flap 140, it is secured to side panel 118 by folding along fold line 142 to be secured thereto by glue or other suitable means known in the art.

Figure 9:
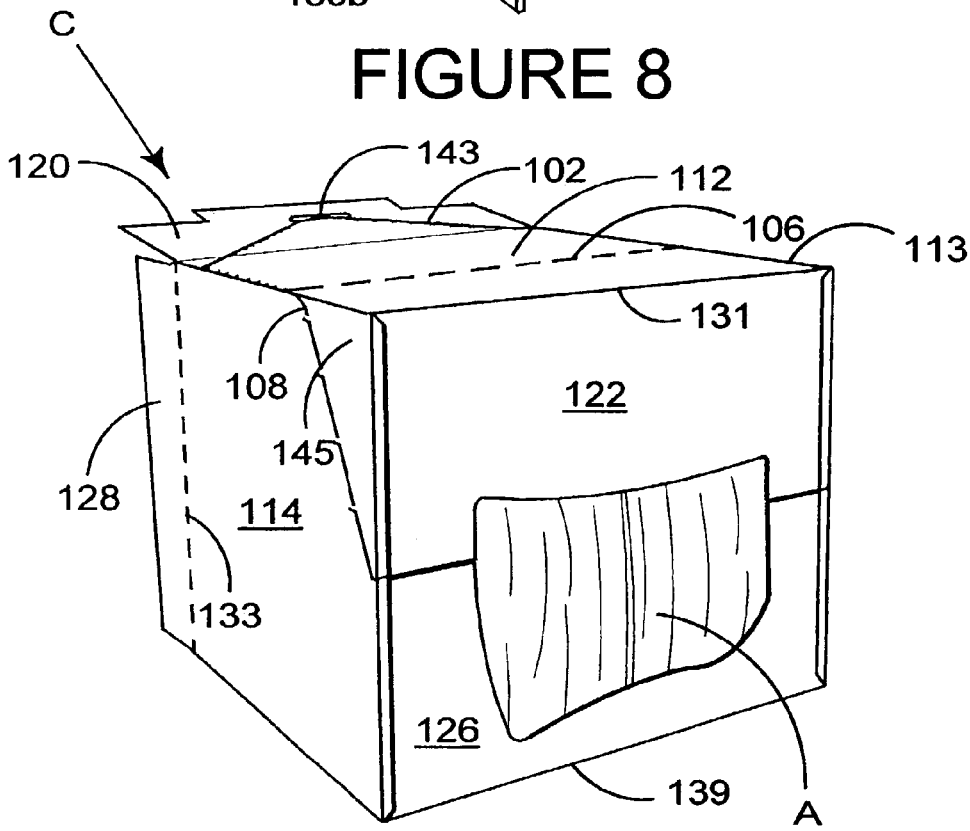

The insert structure is inserted into the carton, as shown in FIG. 8, which helps to brace the outer carton and maintain it in a set up condition. Thereafter the articles are loaded into the carton and the end flaps 130 and 134 and end panels 122, 126 are folded inwardly and secured together to define a display window, as shown in FIG. 9.

Figure 10:
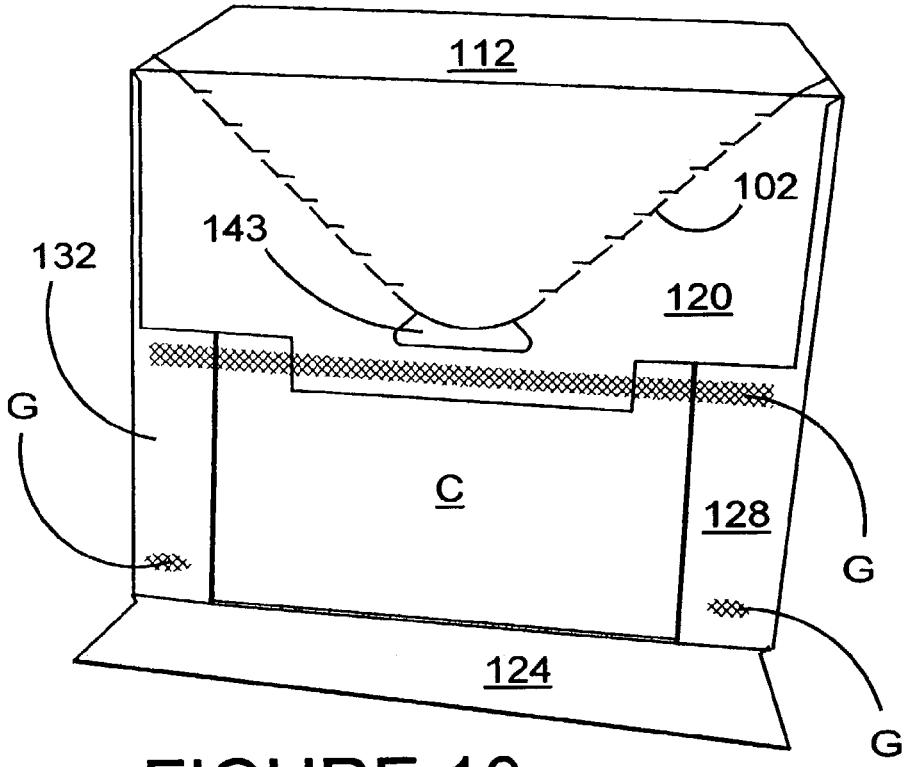

FIG. 10 shows the opposing end wall formed in like manner to the first embodiment whereby end wall panel 120 is folded downwardly along fold line 136 and is, optionally, secured to the end flaps 128 and 132 by glue or other suitable means known in the art. Thereafter, the lower end wall panel 124 is folded inwardly along fold line 133 and secured to the end flaps 128 and 132 by glue, such as glue portions G, or other suitable means known in the art. In order to secure the insert structure to end wall panel 124, a strip of glue G is, in this embodiment, applied in a substantially straight line intermediate opposing side edges of the end flaps such that the glue is applied through recesses 42, 46 to the insert structure.

Figure 11:
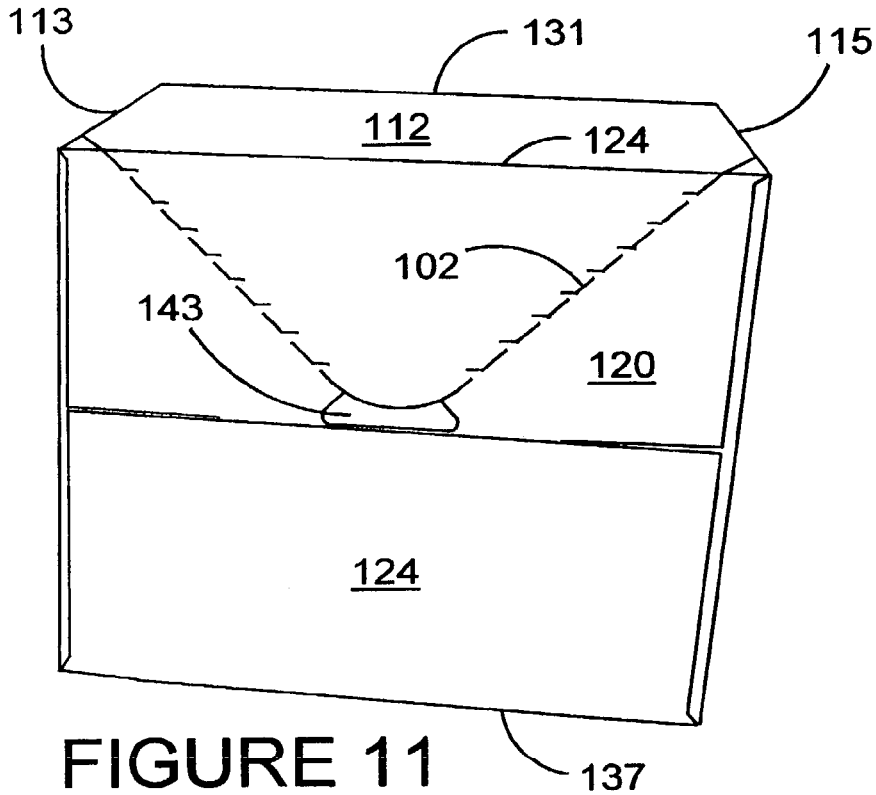
FIG. 11 illustrates the erected and loaded carton illustrated in FIG. 10, with the end panels secured to the end flaps to complete its construction.

By folding the end wall panel 124 inwardly, it is secured in face contacting relationship with the end flaps 128 and 132 and, the part of the insert structure revealed by the recesses 142, 146. In this way, the insert structure is secured directly to an outer wall of the carton by the application of glue in a standard method i.e. using a straight line gluing gun. Thus, the carton is in a set up condition as shown in FIG. 11.

Figure 12:
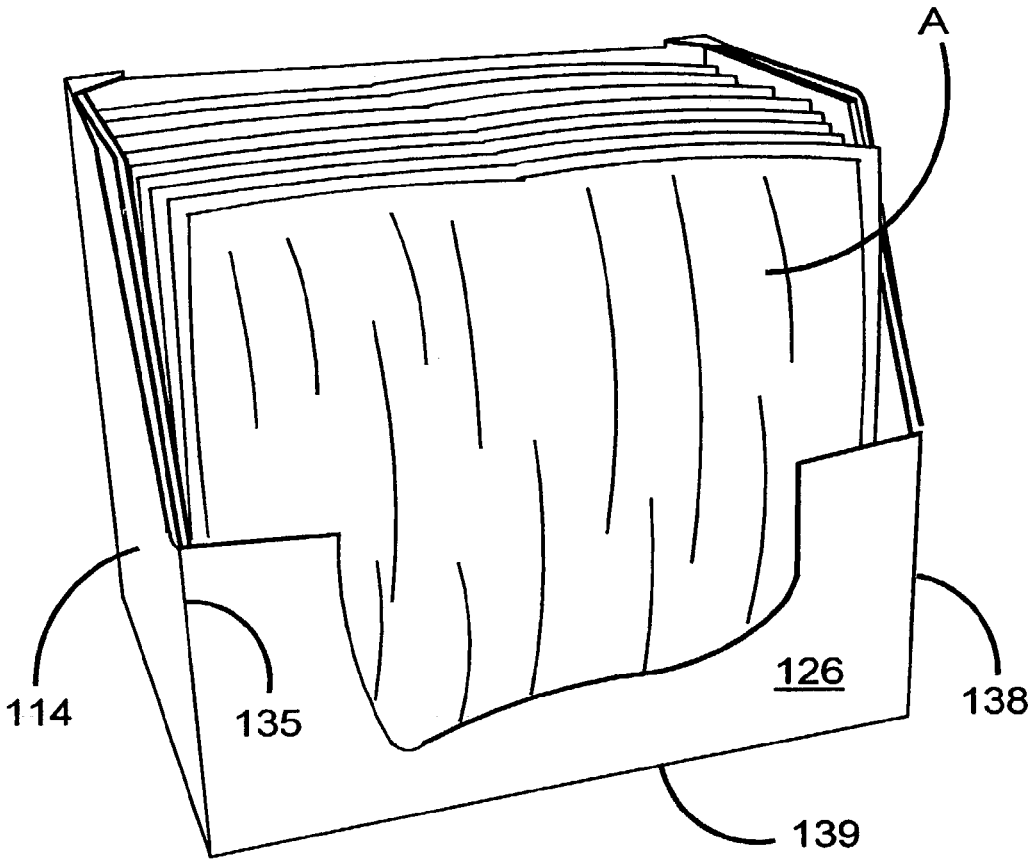
FIGS. 12 and 13 illustrate the carton with the lid removed.
Figure 13:
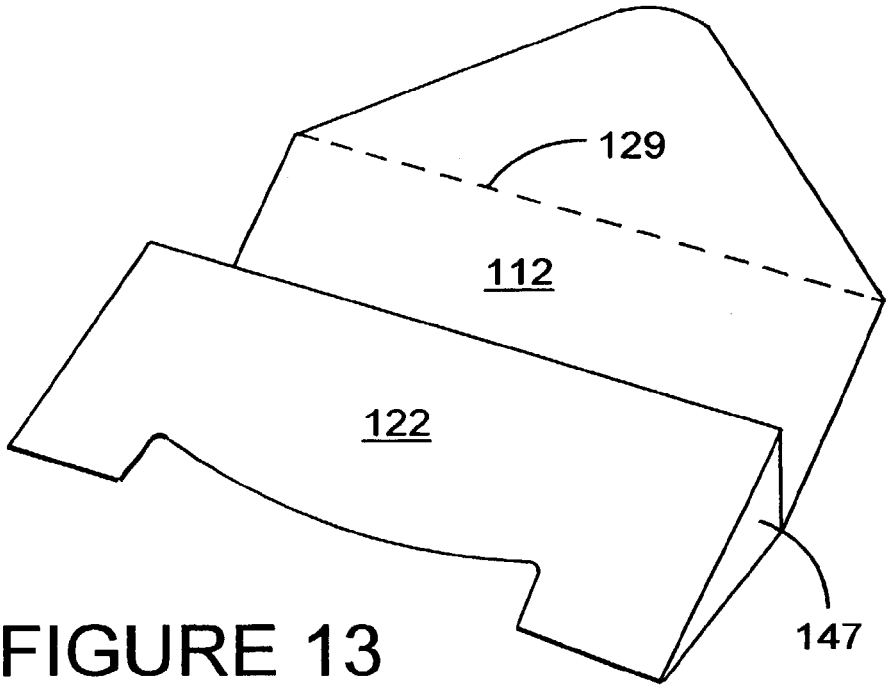

In order to remove the cover to gain access to the interior of the carton, as shown in FIGS. 12 and 13, the user pulls on the pull tab and tears the cover from the carton by tearing along the frangible lines 102, 113, 115, 104, 108, 101 and 103, to separate it as shown in FIG. 13, thereby to reveal the articles A.

Figure 16:
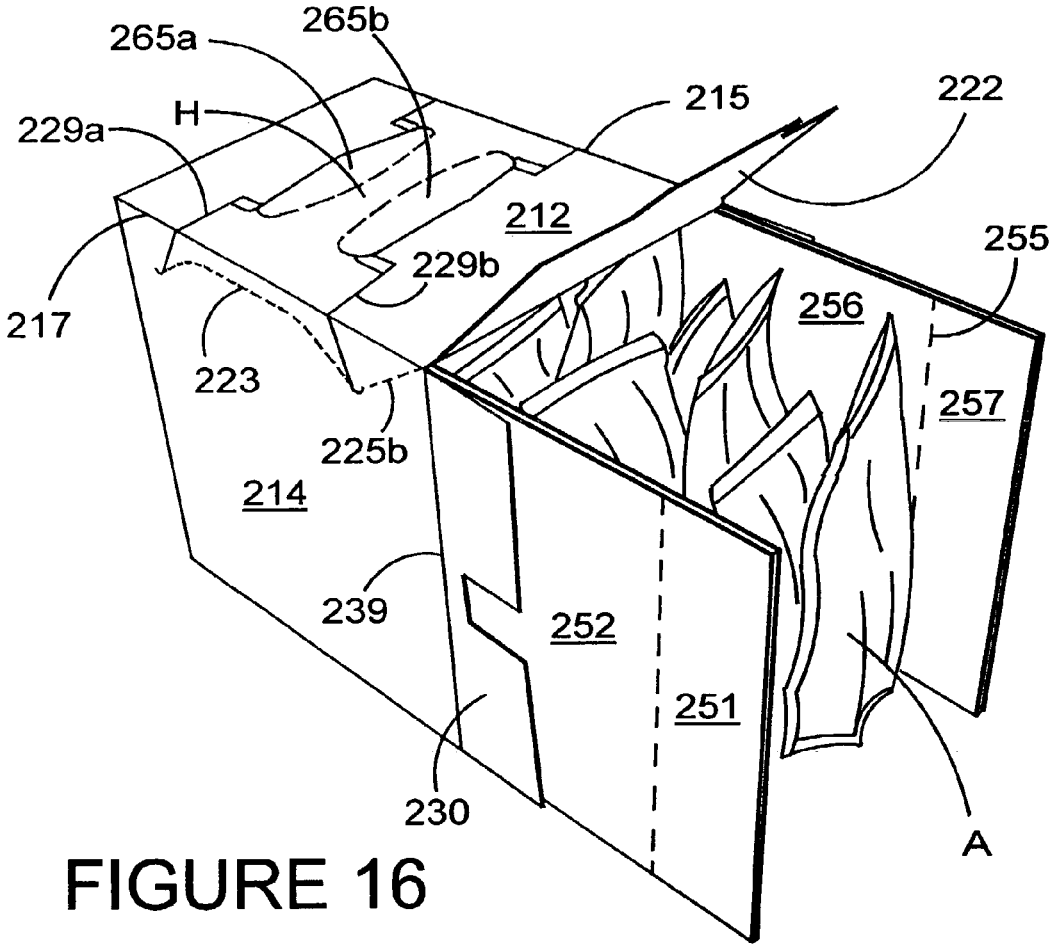
FIGS. 16 and 17 illustrate the construction and loading of the carton from the blank of FIG. 15.
Figure 17:
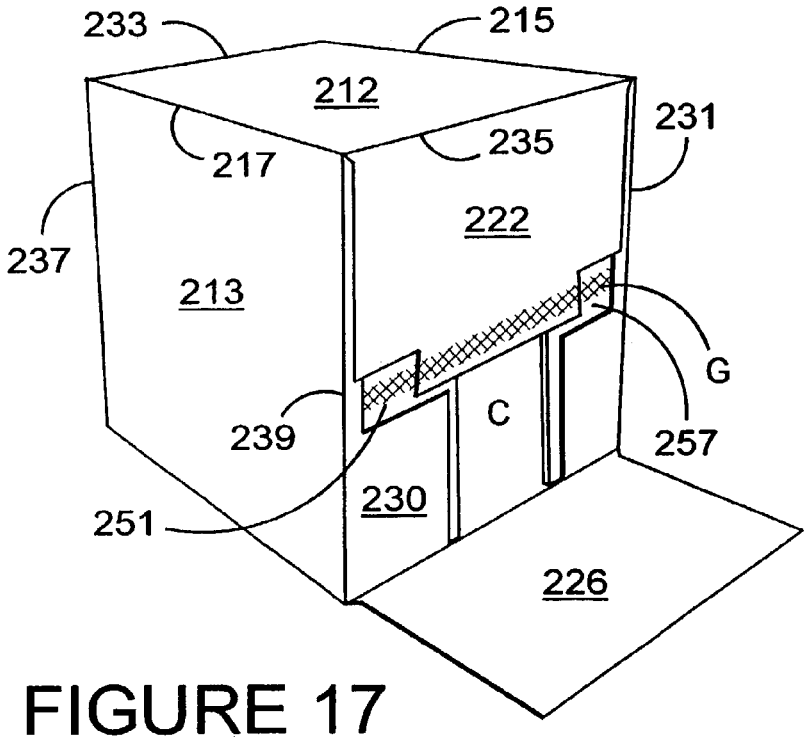

Turning to the third embodiment illustrated in FIG. 16, the outer carton is formed and loaded in an identical manner to that described above. In this embodiment, the insert structure is attached to the outer panels of the end walls at each end. This is achieved by the provision of flaps, 251 and 257 which appear through the recesses 242, 246, as shown in FIG. 17. Thereafter the end wall 226 is secured directly to one or both of panels 251, 257 by the application of glue in a standard method.

Figure 18:
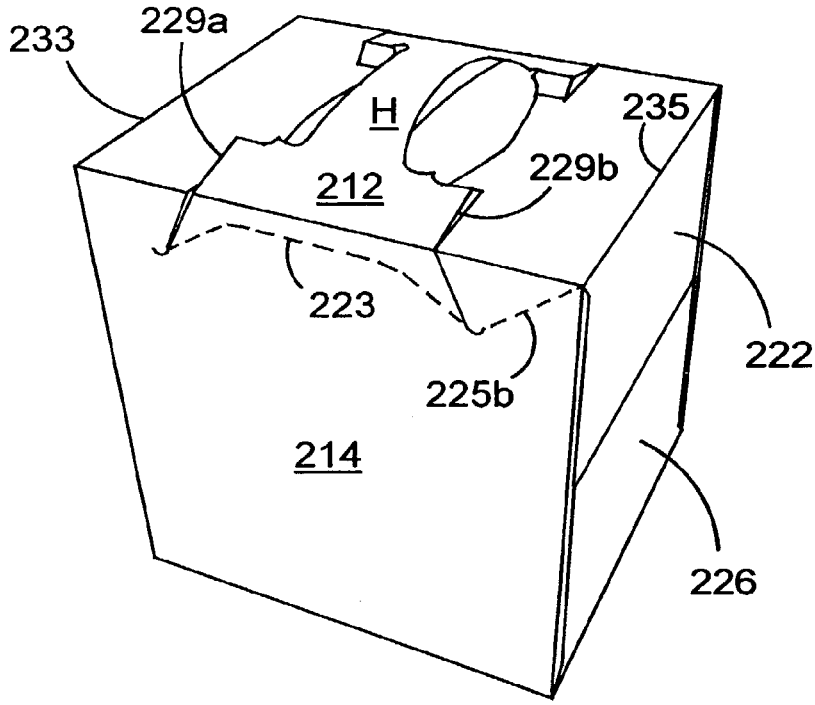
FIG. 18 illustrates the erected and loaded carton illustrated in FIG. 17, with the end panels secured to the end flaps to complete its construction.

The handle is constructed when the user pushes the hand flaps inwardly to reveal the handle strip shown in FIG. 18. Lifting the handle strip will separate it from the top and side walls because of the cut lines 227, 229 and 261. The handle strip is hinged to the top panel 212 by step panels 267, which pivot about their hinged connections between the handle strip H and the side walls 218 and 214 to dissipate some of the load from lifting the handle.

Figure 19:
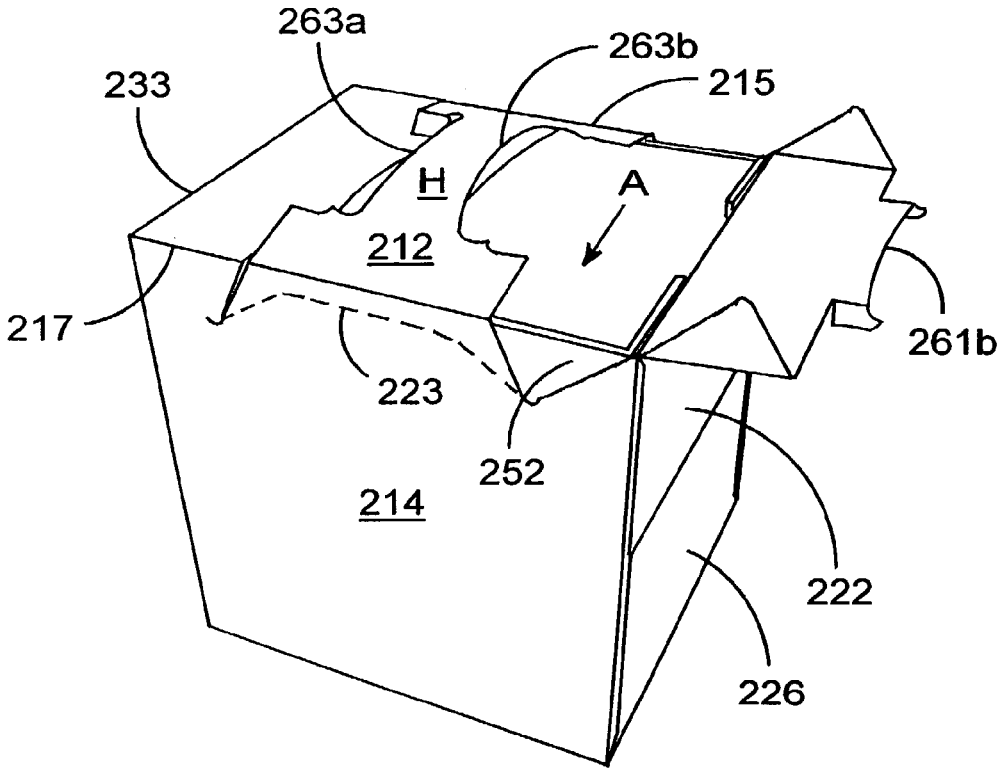
FIG. 19 illustrates the carton with the lid removed.

In order to gain access to the interior of the carton shown in FIG. 19, there is provided a cover panel struck from top panel 212 and hinged to end wall panel 222. Cover panel is frangibly connected to top and side walls by frangible lines 227, 229 and 225 which separates it from the respective panels to reveal the articles contained in the carton.

The present invention and its preferred embodiment relates to an arrangement for securing together the outer end panels and at least one panel of an insert structure, however it is anticipated that the invention can be applied to a variety of carriers and is not limited to those of the fully enclosed type hereinabove described and could be used for numerous applications where it is desired to secure a separate blank to an outer carton in a face contacting relationship in which a single application of glue is used.

It will be recognized that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. A single glue aperture may be provided in some embodiments. The carton may accommodate more than one article in different arrays. Additional panel(s) may be provided between the main and transverse article receiving panels so as to form a curved interface there between.

What is claimed is:

1. A package for carrying one or more articles comprising a carton having a plurality of wall panels for forming a tubular structure, and an insert structure associated with one or more articles and placed within the carton, wherein an end of the tubular structure is closed by a first panel hingedly connected to one of the wall panels and by an intermediate panel hingedly connected to at least one of the other wall panels of the carton to cooperate with the first panel to close said end, the intermediate panel being placed such that at least part of the intermediate panel is disposed in face contacting relationship with an inner face of the first panel, the insert structure including a second panel disposed in face contacting relationship at an outer face thereof with at least part of the intermediate panel, and wherein the intermediate panel is provided with at least one recess for allowing glue applied to said outer face of the second panel on display through said at least one recess to secure together said first and second panels and said intermediate panel in a face contacting relationship, wherein the intermediate panel comprises a first end flap hingedly connected to one of said other wall panels, and said at least one recess comprises a first recess formed in the first end flap, wherein the intermediate panel further comprises a second end flap hingedly connected to another one of said other wall panels, said at least one recess further comprising a second recess formed in the second end flap.

2. A package as claimed in claim 1 wherein the insert structure further includes a first medial panel hingedly connected to the second panel and disposed along one of said other wall panels.

3. A package as claimed in claim 2 wherein the insert structure further includes a second medial panel disposed along another one of the other wall panels disposed opposite to said one of the other wall panels, said first and second medial panels hingedly connected to opposite side edges of said second panel respectively.

4. A package as claimed in claim 3 wherein a transverse partition panel is foldably connected to said first medial panel by a pair of spaced fold lines intermediate opposing ends of the transverse partition panel thereby to create a panel which extends outwardly from both sides of said first medial panel.

5. A package as claimed in claim 4 wherein the second medial panel is provided with a transverse partition panel hingedly connected thereto so as to be secured to the transverse partition panel of the first medial panel.

6. A package as claimed in claim 1, wherein the second recess is disposed in registry with the first recess so that the first and second recesses together define an aperture in the intermediate panel whereby the first panel is secured directly to the second panel by said glue applied to the second panel on display through the aperture.

7. A combination comprising a carton for carrying a plurality of articles and an insert structure placed within the carton, the carton including top, base and opposing side wall panels hingedly connected together to form a tubular stricture, an end panel hingedly connected to the base wall panel and a first end flap hingedly connected to one of the other wall panels, the first end flap being placed such that at least part of the first end flap is disposed in face contacting relationship with an inner face of the end panel, the insert structure including a securing panel disposed in face contacting relationship at an outer face thereof with at least part of the first end flap, wherein a first recess is provided in the first end flap to allow glue during construction of the carton to be applied to said outer face of the securing panel through the first recess so that said end panel is directly secured to the securing panel with the first end flap interposed between the end and securing panels, wherein a second end flap is hingedly connected to another one of said other wall panels and is provided with a second recess, the first and second recesses being disposed in registry with each other so that the first and second recesses together define an aperture through which said glue is applied to the securing panel during the construction of the carton to secure the end panel directly to the securing panel.

8. A combination as claimed in claim 7 wherein the insert structure further includes a medial panel connected to the securing panel and a transverse partition panel struck from the medial panel and foldably connected to the medial panel by a pair of spaced fold lines intermediate opposing ends of the transverse partition panel thereby to create a panel which extends outwardly from both sides of said medial panel.

9. A combination comprising a carton having a plurality of wall panels for forming a tubular structure, and an insert structure placed within the carton, wherein an end of the tubular structure is closed by a first panel hingedly connected to one of the wall panels and by an intermediate panel hingedly connected to at least one of the other wall panels of the carton to cooperate with the first panel to close said end, the intermediate panel being placed such that at least part of the intermediate panel is disposed in face contacting relationship with an inner face of the first panel, the insert structure including a second panel disposed in face contacting relationship at an outer face thereof with at least part of the intermediate panel, and wherein the intermediate panel is provided with at least one recess for allowing glue applied to said outer face of the second panel on display through said at least one recess to secure said first and second panels and said intermediate panel together in a face contacting relationship, wherein the intermediate panel comprises first and second end flaps hingedly connected respectively to two opposed ones of said other wall panels, and said at least one recess comprises first and second registered recesses formed respectively along free side edges of the first and second end flaps.

10. A combination as claimed in claim 9 wherein the insert structure further includes first and second medial panels hingedly connected respectively to opposed side edges of the second panel and disposed along said two opposed wall panels.

* * * * *